United States Patent [19]

Thal, Jr.

[11] Patent Number: 4,742,317

[45] Date of Patent: May 3, 1988

[54] MODE COUPLER FOR MONOPULSE ANTENNAS AND THE LIKE

[75] Inventor: Herbert L. Thal, Jr., Wayne, Pa.

[73] Assignee: General Electric Company, Fairfield, Conn.

[21] Appl. No.: 866,282

[22] Filed: May 23, 1986

[51] Int. Cl.[4] ..... H01P 5/12

[52] U.S. Cl. ..... 333/137; 333/21 R

[58] Field of Search ..... 333/251, 21 R, 21 A, 333/33, 34, 212, 230, 137, 125; 343/777, 786; 342/73, 80, 75, 427

[56] References Cited

U.S. PATENT DOCUMENTS

| | | | |
|---|---|---|---|
| 3,302,111 | 1/1967 | Jones et al. | 333/21 R |
| 3,369,197 | 2/1968 | Giger et al. | 333/21 R |
| 3,673,522 | 6/1972 | Bastikar | 333/251 X |
| 3,760,300 | 9/1973 | Leahy | 333/21 R X |
| 3,821,741 | 6/1974 | D'Oro et al. | 343/786 X |
| 4,060,779 | 11/1977 | Atio et al. | 333/212 |
| 4,148,035 | 4/1979 | Foldes | 343/777 X |
| 4,241,323 | 12/1980 | Griffin et al. | 333/21 A X |
| 4,540,959 | 9/1985 | Saad | 333/251 X |
| 4,566,012 | 1/1986 | Choung et al. | 333/21 R X |
| 4,642,585 | 2/1987 | Saad | 333/34 X |

FOREIGN PATENT DOCUMENTS

| | | | |
|---|---|---|---|
| 44-19443 | 8/1969 | Japan . | |
| 0134957 | 10/1979 | Japan | 333/21 R |
| 0134956 | 10/1979 | Japan | 333/21 R |
| 0124303 | 9/1980 | Japan | 333/251 |
| 0160702 | 8/1985 | Japan | 333/21 R |

*Primary Examiner*—Eugene R. LaRoche
*Assistant Examiner*—Seung Ham
*Attorney, Agent, or Firm*—Clement A. Berard, Jr.; William H. Meise

[57] ABSTRACT

A coupler for extracting energy in the $TE_{21}$ mode from a circular waveguide propagating energy in both the $TE_{11}$ and $TE_{21}$ modes, characterized in that an annular iris on the inner circumference of the waveguide and a longitudinally stepped transition portion of the waveguide define therebetween a $TE_{21}$ mode resonant cavity which is coupled via a narrow axially extending rectangular slot contained in the wall portion of the waveguide which defines the cavity. At least one external resonant chamber may be provided on the waveguide through which the $TE_{21}$ mode energy is extracted and transmitted to a detector thereof via the slot, which chamber cooperates with the resonant cavity to define a multiple resonant filter for improving the matching to the $TE_{21}$ mode while reducing the perturbation to the $TE_{11}$ mode.

4 Claims, 5 Drawing Sheets

FIG. 1
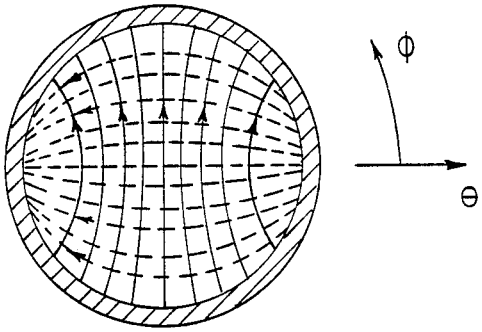
$A_{TE_{11}}$
FIG. 2
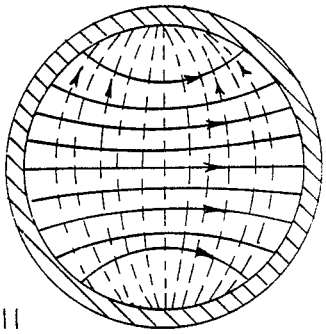
$B_{TE_{11}}$
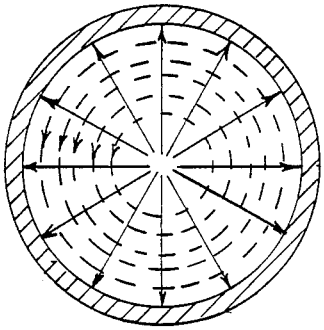
$TM_{01}$
FIG. 3
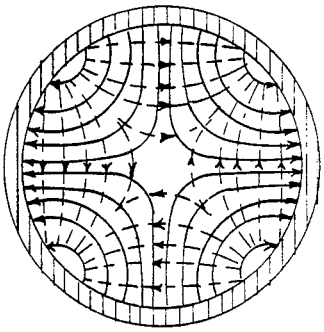
$A_{TE_{21}}$
FIG. 4

MODE COUPLER FOR MONOPULSE ANTENNAS AND THE LIKE

STATEMENT OF THE INVENTION

This invention relates to a coupler for separating microwave energy in the $TE_{21}$ mode from a circular waveguide propagating energy in both the $TE_{11}$ and $TE_{21}$ modes in such a manner as to avoid perturbation to the $TE_{11}$ mode signal.

BRIEF DESCRIPTION OF THE PRIOR ART

A typical communications or radar antenna produces a "pencil" beam pattern containing a peak along some axis. In a "monopulse" system, a second pattern with a null along this axis is used to provide a "delta" pattern which produces an error signal useful for pointing or tracking. This delta pattern can be produced, for example, by adding four auxiliary (horn) antennas around the primary antenna. Alternatively, it may utilize a different mode within the primary antenna. For example, the BSII TV satellite monopulse system utilizes the $TM_{01}$ mode for the delta pattern and the $TE_{11}$ mode in the same conical horn for the primary or "sum" pattern.

Waveguide mode couplers are well known in the patented prior art, as evidenced, for example, by the prior patents to Giger et al U.S. Pat. No. 3,369,197, Ajioka U.S. Pat. No. 3,566,309, Moerz et al U.S. Pat. No. 4,473,828 and Ekelman et al U.S. Pat. No. 4,504,805, among others. In Japanese Pat. No. 124,302, a $TE_{21}$ mode detector is coupled with a $TM_{01}$ mode and at the same time mixed with a $TE_{11}$ mode wave. $TE_{21}$ mode detectors and/or couplers are generally disclosed in the Japanese Pat. Nos. 134,956 and 134,957. The various modes of microwave energy transmission in a circular waveguide—including $TM_{01}$, $TM_{11}$, $TE_{11}$ and $TE_{21}$ is disclosed in the British Pat. No. 855,026.

The present invention was developed to demonstrate the critical components for a single-horn monopulse feed which are compatible with a beam waveguide feed system. The complete assembly consists of a feed horn, a coupler for removing a delta mode signal, a polarizer for the $TE_{11}$ mode communications signal, and an orthomode coupler which transforms the desired component to a rectangular output waveguide and terminates the undesired orthogonal component, the greatest emphasis being placed on the delta mode coupler.

The basic equations for monopulse operation valid at small aspect angles are as follows:

$$\begin{aligned}
\mathrm{A}TE_{11}:\quad & E_\phi \approx \cos\phi \\
& E_\theta \approx \sin\phi \\
\mathrm{BTE}_{11}:\quad & E_{100} \approx -\sin\phi \\
& E_\theta \approx \cos\phi \\
TM_{01}:\quad & E_\phi = 0 \\
& E_\theta \approx A\,\theta \\
\mathrm{A}TE_{21}:\quad & E\phi \approx -B_1\theta \sin 2\,\phi \\
& E\theta \approx B_2\theta \operatorname{cis} 2\,\phi
\end{aligned}$$

$$B_1 \approx B_2 \approx A$$

For circular polarization, $E = E_\theta + j\,E_\theta$ Thus, $$\mathrm{A}TE_{11}:\ Ecp \approx \sin\phi + j\cos\phi = j\,e^{-j\phi}$$

-continued $$\mathrm{B}TE_{11}:\ Ecp \approx \cos\phi - j\sin\phi = e^{-j\phi}$$

$$TM_{01}:\ Ecp \approx A\theta$$

$$\mathrm{A}TE_{21}:\ Ecp \approx [B_2\cos 2\,\phi - j\,B_1 \sin 2\,\phi]\,\theta \approx B\theta\,e^{-j2\phi}$$

$$\mathrm{B}TE_{11} - j^{A}TE_{11}:\ Ecp\ (after\ polarizer) \approx \sqrt{2}\ e^{-j\phi}$$

The two $TE_{11}$ waveguide modes form the sum mode pattern which has a maximum on axis and is assumed constant over the aspects of interest for a simplified analytical model. Either the $TM_{01}$ singlet mode or one of the $TE_{21}$ doublets may be used for the delta pattern. In both cases the field amplitude increases approximately linearly with aspect angle from an on-axis null. For a circularly polarized system the amplitude and phase of the $TM_{01}$ signal are independent of the roll angle $\phi$; the $TE_{21}$ amplitude is independent but its phase varies as the exponent $(-j\ 2\phi)$. Since the $TE_{11}$ sum signal is essentially constant in amplitude but varies in phase as the exponent $(-j\phi)$, its ratio with either the $TM_{01}$ or the $TE_{21}$ signal has an amplitude proportional to the aspect angle and a phase proportional to $\pm\phi$. (The output from an actual demodulator may be $(r, \phi)$ or $(x, y)$ depending on the method used.) Thus, the choice between $TM_{01}$ and $TE_{21}$ may be made on the basis of which mode is easier to couple.

The $TE_{21}$ mode was selected since it can be coupled through a longitudinal slot. If the coupler is located at a waveguide diameter where the $TE_{21}$ mode is just above its cutoff, there are large transverse currents which couple effectively to the slot. But at this diameter the $TE_{11}$ mode is far above cutoff so that its currents are primarily longitudinal and parallel to the slot and therefore not effectively coupled. Thus there is preferential coupling to the $TE_{21}$ mode and minimal impact on the $TE_{11}$. By contrast the $TM_{01}$ mode or any TM mode for that matter can be excited only by a transverse slot since it has only longitudinal currents; also its cutoff diameter is closer to that of the $TE_{11}$. Therefore it is substantially more difficult to obtain selective $TM_{01}$ excitation.

Three general approaches for coupling the $TE_{21}$ mode were considered: (1) a single-sided configuration with just one slot; (2) a balanced arrangement in which a pair of diametrically opposite slots are fed by a magic tee junction; (3) a pair of opposing slots coupled to a single yoke-shaped or circumferential resonant cavity. The experimental work was directed principally at the first since it offers the advantage of mechanical and electrical simplicity which is particularly significant at higher frequencies.

SUMMARY OF THE INVENTION

According to a primary object of the present invention, a coupler is provided for separating or decoupling microwave energy of the $TE_{21}$ mode from a circular waveguide propagating microwave energy in both the $TE_{11}$ and $TE_{21}$ modes, including a circular waveguide connected at its ends, respectively, with a $TE_{11}$ energy detector and with a source (such as an antenna), characterized by the provision of means defining a resonant $TE_{21}$ cavity within the circular waveguide. More particularly, the resonant $TE_{21}$ cavity is defined between an annular iris coaxially arranged on the inner circumferential surface of the circular waveguide adjacent the source end thereof, and a stepped transformer or transition section coaxially arranged in the waveguide in longitudinally spaced relation to the iris adjacent the $TE_{11}$ energy detector end of the waveguide, the stepped transformer portion being operable to pass only the $TE_{11}$ energy, and to reflect substantially all of the $TE_{21}$ energy. A wall portion of the circular waveguide defining the resonant cavity contains an axially extending slot through which the $TE_{21}$ mode microwave energy is introduced into the cavity.

According to a further object of the invention, housing means are provided externally of the circular waveguide for defining a rectangular resonant chamber in communication with the cavity via the axial slot, thereby to cooperate with the cavity to create a two-pole filter.

A further object of the invention is to provide a coupler of the type described above, wherein the circular waveguide contains a second axial slot diametrically arranged relative to the first slot, $TE_{21}$ mode microwave energy being extracted from said resonant cavity via said second slot.

BRIEF DESCRIPTION OF THE DRAWINGS

Other objects and advantages of the invention will become apparent from a study of the following specification, when viewed in the light of the accompanying drawings, in which:

FIGS. 1–4 are diagrammatic illustrations of various microwave modes of operation in a circular waveguide;

DETAILED DESCRIPTION

Figure 5:
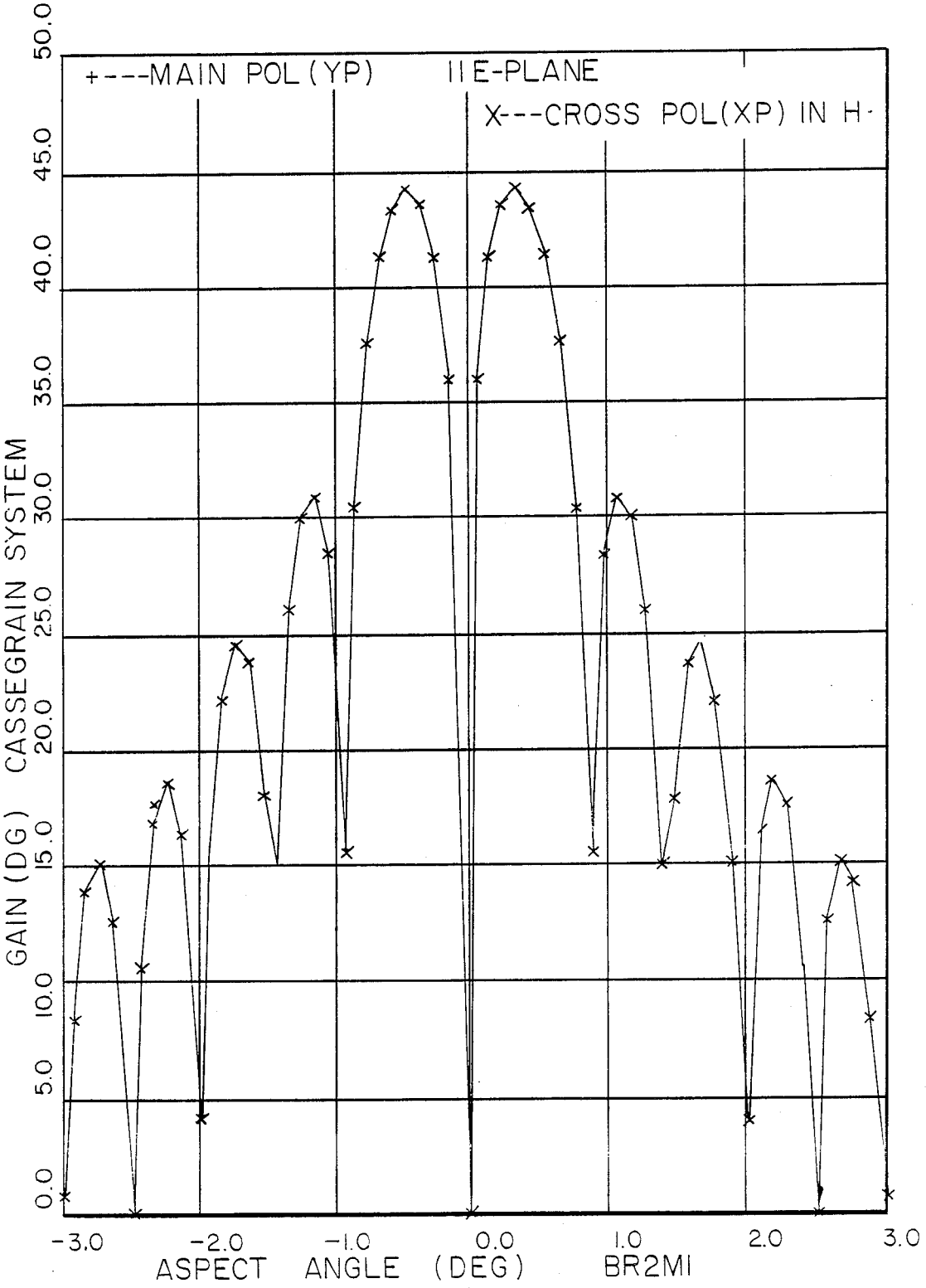
FIG. 5 is a curve illustrating the antenna patterns obtained by connecting a $TE_{21}$ delta mode coupler with a feed horn and a Cassegrain system and by computing the response at the rectangular port.

FIGS. 1–4 illustrate the known mode patterns for the modes $^{A}TE_{11}$, $^{B}TE_{11}$, $TM_{01}$ and $^{A}TE_{21}$, respectively, and FIG. 5 illustrates a computed $TE_{21}$ mode difference pattern after passing through a Cassegrain reflector system, the desired features being preserved.

Figure 6:
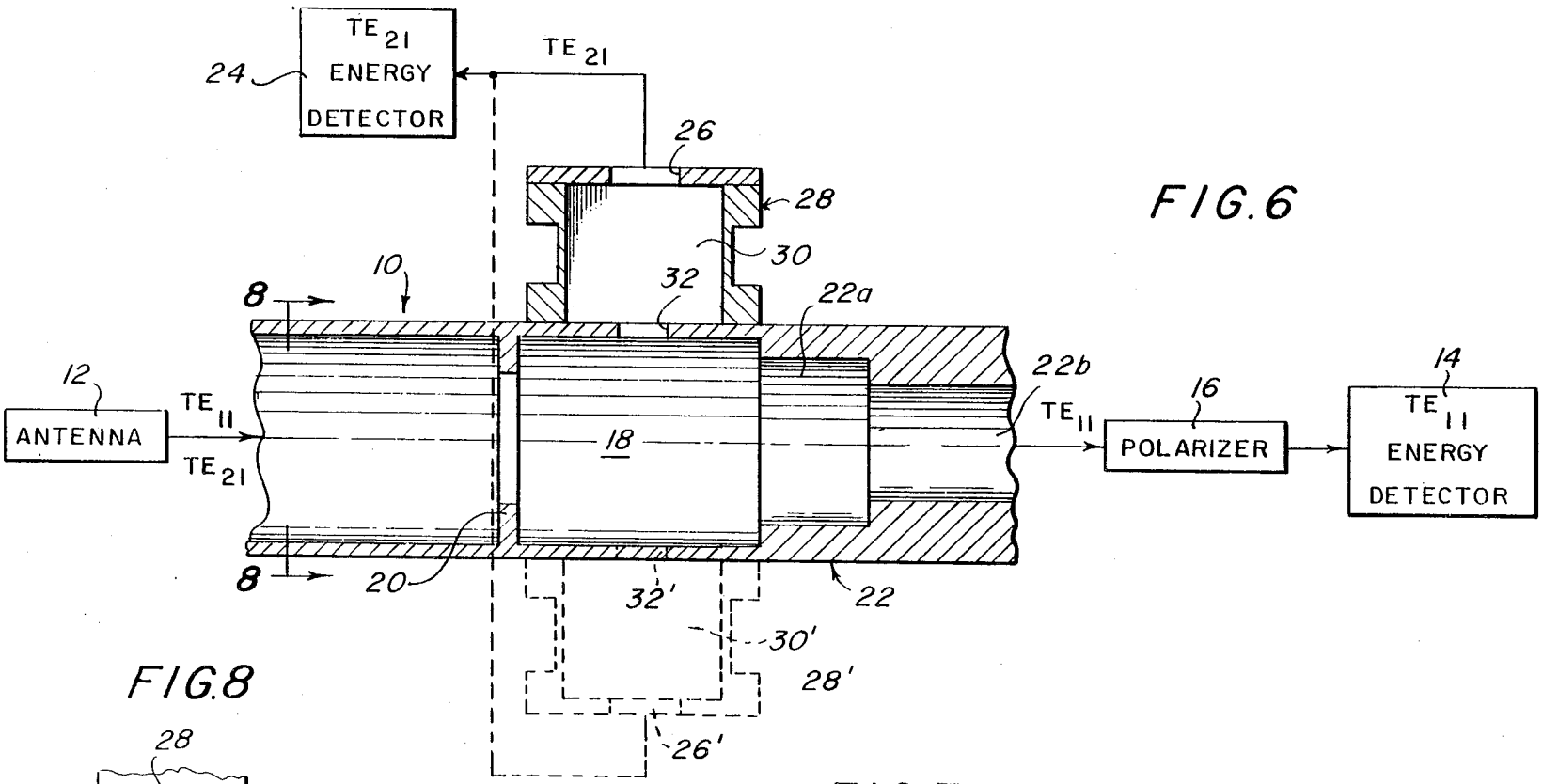
FIG. 6 is a schematic diagram illustrating in longitudinal cross-section the coupler of the present invention.
Figure 7:
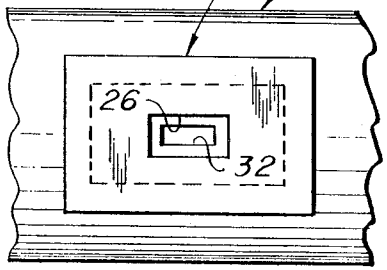
FIG. 7 is a detailed top plan view of the $TE_{21}$ resonator input chamber of the apparatus of FIG. 6.
Figure 8:
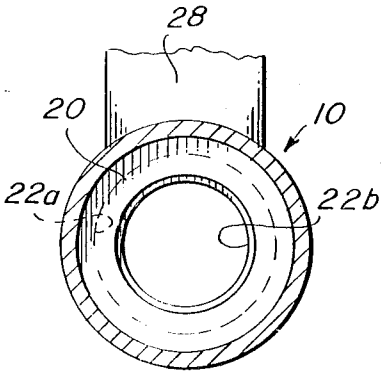
FIG. 8 is a sectional view taken along line 8—8 of FIG. 6.

Referring now to FIGS. 6–8, the $TE_{21}$ coupler of the present invention is operable to remove microwave energy from the $TE_{21}$ mode of a circular waveguide 10 propagating both the $TE_{11}$ mode and the $TE_{21}$ mode signal. In the illustrated embodiment, the apparatus is in the reception mode (although it could be used in a transmit mode), with microwave energy in the $TE_{11}$ and $TE_{21}$ modes being supplied from antenna 12 to the $TE_{11}$ energy detector 14 via the circular waveguide 10 and the polarizer 16. In accordance with a characterizing feature of the invention, a resonant chamber 18 is defined in the circular waveguide 10 between annular iris 20 formed on the inner circumference of the circular waveguide, and a stepped waveguide transition portion 22 that passes the $TE_{11}$ mode energy, but reflects $TE_{21}$ energy supplied from antenna 12 to slot 26 contained in externally mounted housing 28 via resonant cavity 18, axial slot 32 contained in the wall portion of the circular waveguide, and resonant chamber 30 defined within housing 28. The iris 20 and stepped transformer portion 22 are substantially reflectionless for the $TE_{11}$ mode, since the $TE_{11}$ mode is far above its cutoff frequency.

The design of this circular waveguide configuration was facilitated by the development of a computer routine for analyzing step discontinuities and irises in circular guide. This routine predicted that certain combinations of step size and diameter-to-wavelength ratio yield low reflections. These predictions were subsequently verified experimentally.

Figure 9:
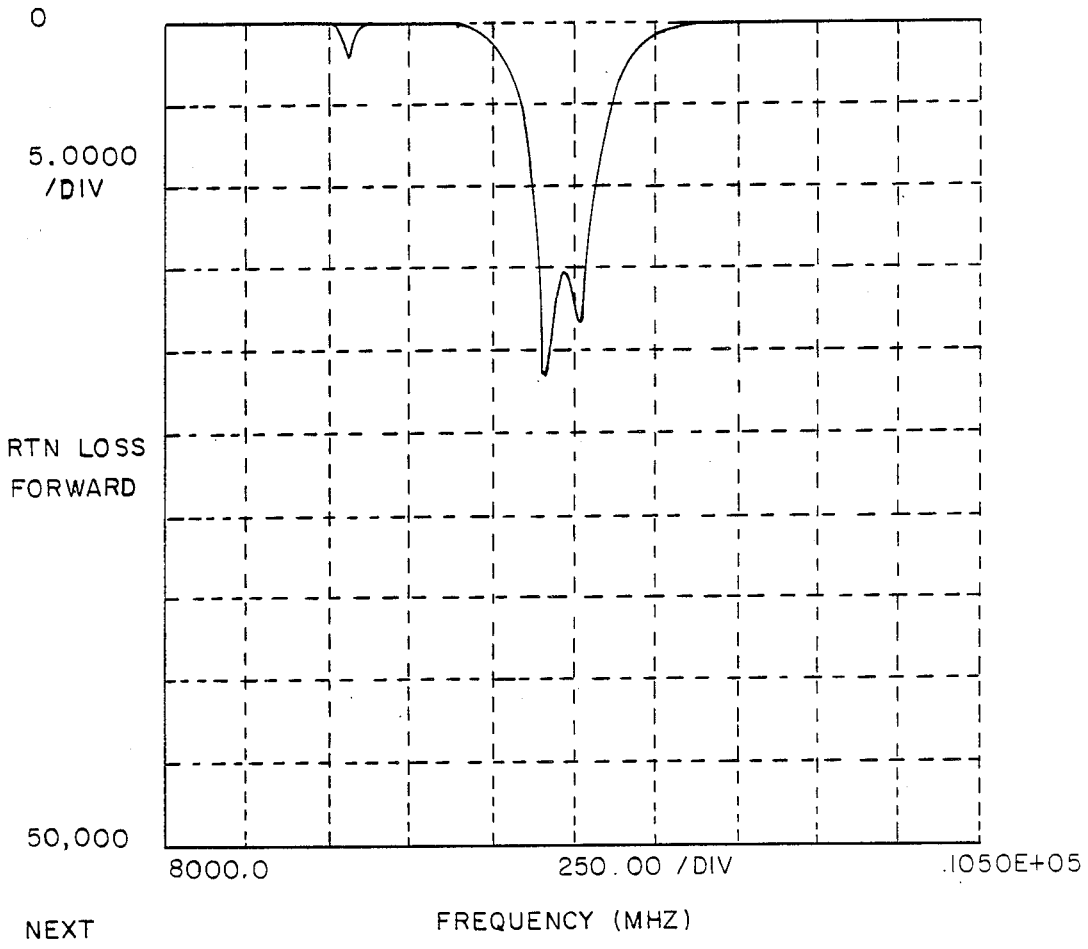
FIG. 9 is a curve illustrating the measured return loss of the two-pole filter defined at the rectangular axial port of FIG. 6.

The rectangular waveguide chamber 30 cooperates in conjunction with the circular cylindrical cavity 18 defined between iris 20 and stepped transition portion 22 to define a two-pole filter. FIG. 9 shows the return loss of this filter at the rectangular port 26 measured on an automatic network analyzer.

Figure 10:
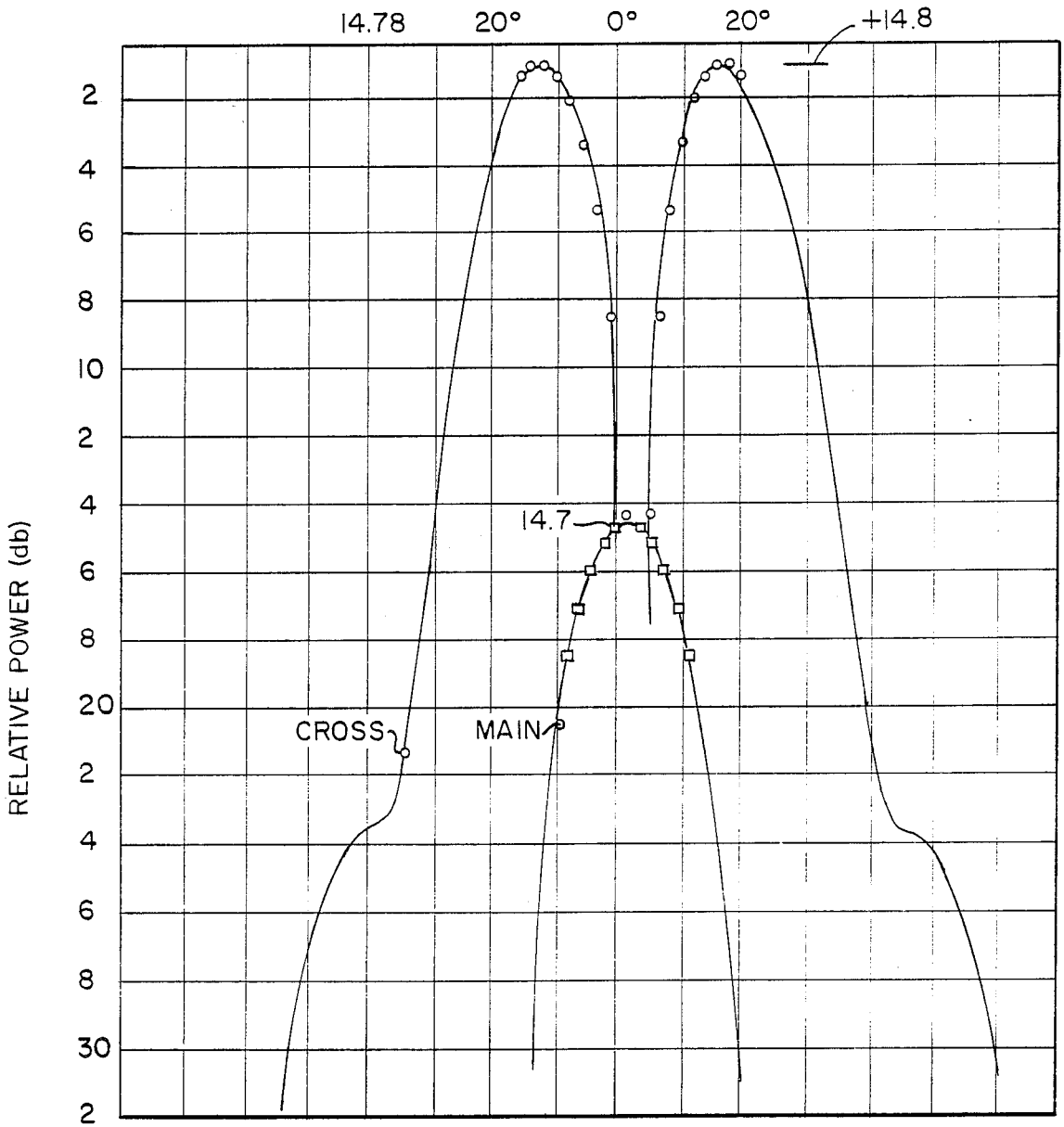
FIG. 10 illustrates the antenna patterns obtained by connecting the coupler to a feed horn and measuring the response at the rectangular port.

FIG. 10 shows antenna patterns obtained by connecting this coupler to a feed horn and measuring the response at the rectangular port for illumination by two orthogonal linearly polarized waves. The pattern with the null is due to the desired $TE_{21}$ mode; the weaker cross-polarized lobe is due to residual $TE_{11}$ excitation. This level of isolation should be adequate for certain applications. Some isolation improvement may be achieved with the single-sided design by adding rectangular cavities to increase the order of the filter or by decreasing the filter bandwidth or both. If desired, one or more additional resonant chambers could be provided for cooperation with chamber 30 to define a multiple resonant filter to improve the matching to the $TE_{21}$ mode while reducing the perturbation to the $TE_{11}$ mode.

Alternatively when greater isolation is required, a two-slot balanced scheme may be employed by adding a second axial slot 32' plus one or more additional chambers 30' diametrically opposite the first slot 32, as shown in phantom in FIG. 6. The outputs of the two filters are then combined such that they reinforce through a T junction. Owing to its symmetry, the double-sided version does not yield any significant residual sum pattern.

What is claimed is:

1. A coupler for extracting microwave energy of the $TE_{21}$ mode from a circular waveguide propagating microwave energy in both the $TE_{11}$ and $TE_{21}$ modes, comprising (a) circular waveguide means adapted for connection at a load end with a $TE_{11}$ mode detector and at a source end to supply means propagating both $TE_{11}$ and $TE_{21}$ modes, respectively;

(b) means defining a resonant $TE_{21}$ cavity within said circular waveguide means, including (1) annular iris means coaxially arranged on the inner circumferential surface of said circular waveguide means adjacent said source end thereof; and (2) a transformer section coaxially arranged in said waveguide means in longitudinally spaced relation to said iris means adjacent said load end of said waveguide means, said transformer means being operable to pass the $TE_{11}$ energy and to reflect substantially all of the $TE_{21}$ energy;

(3) a wall portion of said circular waveguide means located between said iris means and said transformer section, said wall portion defining an axial first slot; and (C) means for extracting $TE_{21}$ mode microwave energy from said cavity via said slot.

2. Apparatus as defined in claim 1, wherein said means for extracting $TE_{21}$ mode microwave energy from said cavity includes first housing means mounted externally of said waveguide means at said first slot, said first housing means containing a resonant chamber in communication with said cavity via said slot, thereby to cooperate with said cavity to create a two-pole filter, said first housing means including an output slot.

3. Apparatus as defined in claim 2, wherein said waveguide means contains a second axial slot (32') diametrically arranged relative to said first slot, said $TE_{21}$ energy being also extracted from said cavity via said second slot.

4. Apparatus as defined in claim 3, wherein said means for extracting the $TE_{21}$ energy from said cavity further includes second housing means mounted externally of said waveguide means to define a second resonant chamber in communication with said cavity via said second slot, said second housing means including an output slot opposite said second slot.

* * * * *